US008564486B2

(12) United States Patent
Wang et al.

(10) Patent No.: US 8,564,486 B2
(45) Date of Patent: Oct. 22, 2013

(54) HOLDING DEVICE WITH AN ANTENNA AND METHOD FOR ASSEMBLING THE SAME

(75) Inventors: Tun-Ping Wang, Taipei (TW); Ho-Hsin Chou, Taipei (TW); Jeng-Hsiang Lee, Taipei (TW); Jun-Long Wu, Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 817 days.

(21) Appl. No.: 12/752,103

(22) Filed: Mar. 31, 2010

(65) Prior Publication Data

US 2011/0241970 A1 Oct. 6, 2011

(51) Int. Cl.
*H01Q 1/24* (2006.01)

(52) U.S. Cl.
USPC ..... 343/702; 439/630

(58) Field of Classification Search
USPC ..... 343/882, 702; 29/600; 439/630
See application file for complete search history.

(56) References Cited

U.S. PATENT DOCUMENTS

| | | | | |
|---|---|---|---|---|
| 7,798,858 | B1 * | 9/2010 | Zuo | 439/630 |
| 8,223,502 | B2 * | 7/2012 | Shen et al. | 361/748 |
| 2001/0043160 | A1 * | 11/2001 | Hirai et al. | 343/702 |

OTHER PUBLICATIONS

RF-Link 5.8GHz Audio/Video Sender, user manual, by RF-Link, offered for sale Sep. 14, 2004.*

* cited by examiner

*Primary Examiner* — Hoang V Nguyen
*Assistant Examiner* — Kyana R McCain

(57) ABSTRACT

A holding device having a printed circuit board includes a base having a securing recess at a top surface thereof, a securing connector fixed in the securing recess and connected with the printed circuit board, a holding shell rotatably covered to the securing connector, and a flexible antenna of flat plate shape. The antenna has a rectangular radiating body, and a strip-shaped connecting portion extended outwards from a side of the radiating body. A free end of the connecting portion is held by the holding shell and rotated to connect with the securing connector electrically and detachably. An exposed portion of the connecting portion is bent so that the radiating body is attached to the top surface of the base.

15 Claims, 5 Drawing Sheets

HOLDING DEVICE WITH AN ANTENNA AND METHOD FOR ASSEMBLING THE SAME

BACKGROUND OF THE INVENTION

1. Field of the Invention

The present invention relates to a holding device, and more specifically to a holding device with an antenna and method for assembling the same.

2. The Related Art

Near Field Communication (NFC), is a short-range high frequency wireless communication technology which enables the exchange of data between devices over about a 10 centimetre (around 4 inches) distance. The technology is a simple application of the ISO/IEC 14443 proximity-card standard (contactless card, RFID) that combines the interface of a smartcard and a reader into a single device. An NFC device can communicate with both existing ISO/IEC 14443 smartcards and readers, as well as with other NFC devices, and is thereby compatible with existing contactless infrastructure already in use for public transportation and payment. NFC is primarily aimed at usage in mobile phones. An NFC antenna is mounted to a printed circuit board of the mobile phone. However, it is liable to affect the NFC antenna to send and receive the signals when the NFC antenna is located adjacent to the electronic components of the mobile phone. But, the NFC antenna is mounted to the printed circuit board and spaced away from the electronic components of the mobile phone with a predetermined distance, which enlarges the volume of the mobile phone and is inconvenient for users to carry and use. In addition, the conventional NFC antenna is permanently fixed to the printed circuit board of the mobile phone. Once the mobile phone fails to work, the NFC antenna manufactured with high expense has to be discarded as worthless, resulting in the waste of the NFC antenna.

SUMMARY OF THE INVENTION

An object of the invention is to provide a holding device with an antenna. The holding device having a printed circuit board includes a base having a securing recess at a top surface thereof, a securing connector fixed in the securing recess and connected with the printed circuit board, a holding shell rotatably covered to the securing connector, and the flexible antenna of flat plate shape. The antenna has a rectangular radiating body, and a strip-shaped connecting portion extended outwards from a side of the radiating body. A free end of the connecting portion is held by the holding shell and rotated to connect with the securing connector electrically and detachably. An exposed portion of the connecting portion is bent so that the radiating body is attached to the top surface of the base.

Another object of the invention is to provide a method for assembling a flexible antenna to a holding device, the method comprises the steps of:

lifting a holding shell upwards;

putting a free end of a connecting portion of the antenna into a space formed by the holding shell;

inserting a card between a covering plate of the holding shell and the connecting portion;

rotating the holding shell to cover an insulating housing of a securing connector; and folding an exposed portion of the connecting portion to overlap on the holding shell, with a radiating body of the antenna attached to a top of a base.

As described above, the antenna is flexible. Therefore, the antenna can be assembled in the holding device in a folding manner, which reduces occupied space and is away from other electrical components of the holding device, consequently, preventing from the interference and improving the quality of receiving and sending the signals. Furthermore, the antenna is detachably mounted to the holding device, which prolongs the use time of the antenna and saves resource.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE EMBODIMENT

Figure 1:
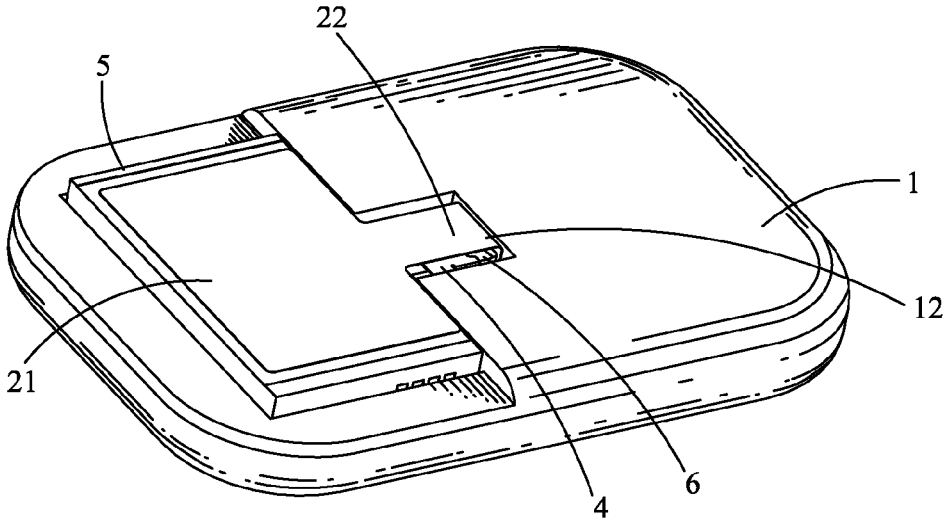
FIG. 1 is an assembled, perspective view of a holding device of an embodiment in accordance with the present invention.
Figure 2:
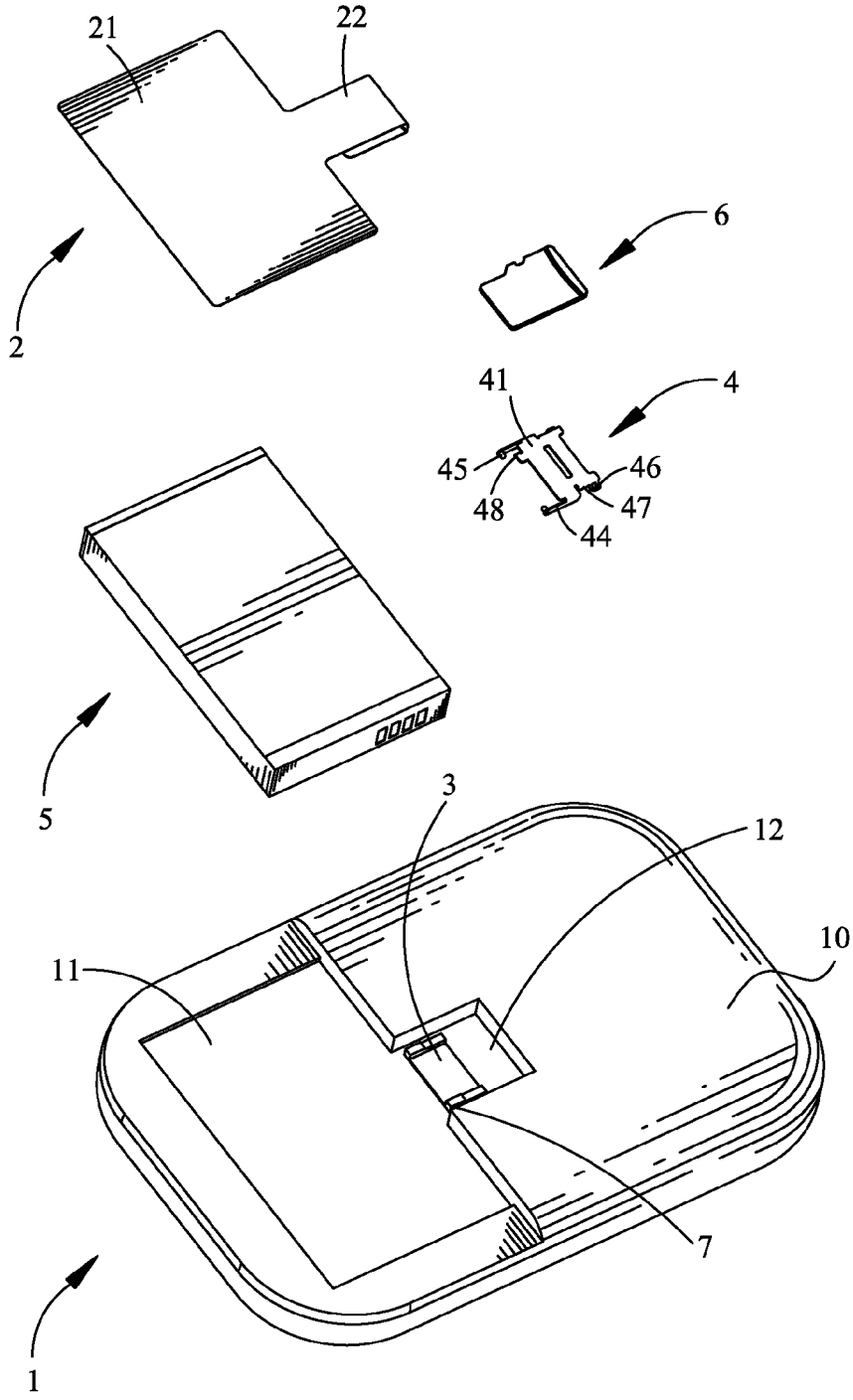
FIG. 2 is an exploded, perspective view of the holding device shown in FIG. 1.

With Reference to FIGS. 1-2, an embodiment of a holding device according to the present invention is shown. The holding device comprises a base 1, a flexible antenna 2 detachably mounted to the base 1, a securing connector 3 and a holding shell 4 mounted to the base 1.

Figure 5:
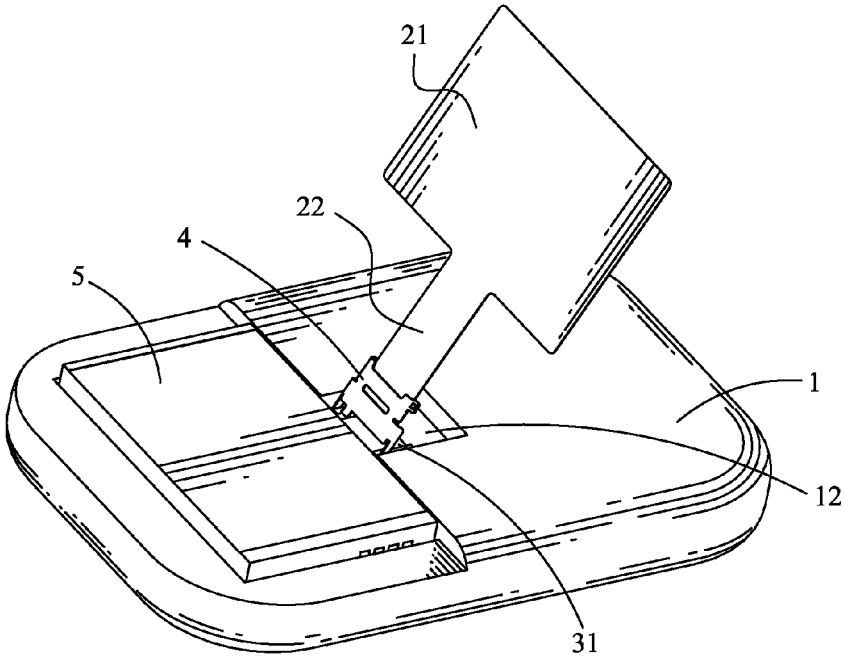
FIGS. 5-8 show a process of the antenna assembled to the holding device of FIG. 1.

Please refer to FIG. 2 and FIG. 5, taking a mobile phone for example, a top surface 10 of the base 1 of the mobile phone has a receiving trough 11 at a front end thereof, for receiving a battery 5, and a securing recess 12 located at a substantially middle portion of a rear side of the receiving trough 11, for accommodating the securing connector 3. The securing recess 12 communicates with the receiving trough 11. The securing connector 3 includes an insulating housing 31 and a plurality of terminals (not shown) mounted to the insulating housing 31. The insulating housing 31 is fixed in the securing recess 12 and has two pivoting holes 7 at front ends of two opposite sides thereof, adjacent to the receiving trough 11. The terminals have ends soldered to a printed circuit board (PCB, not shown) for forming electrical connection.

Figure 4:
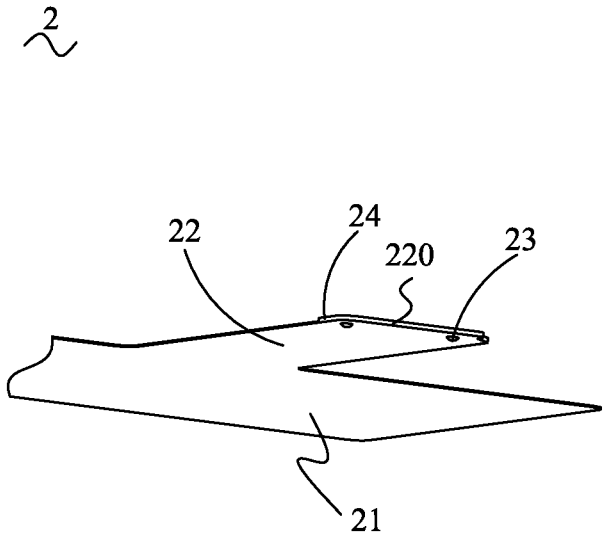
FIG. 4 is a perspective view of an antenna of the holding device shown in FIG. 1.

Referring to FIG. 2 and FIG. 4, the antenna 2, which is made of flexible printed circuit board, has a rectangular radiating body 21 and a connecting portion 22 of strip shape extended from a middle portion of a rear side of the radiating body 21. The length of the connecting portion 22 is substantially twice as the length of a card 6. A free end 220 of the connecting portion 22 has two abreast contacting spots 23 at a bottom surface thereof and a transverse stopping rib 24 at a top surface thereof.

Figure 3:
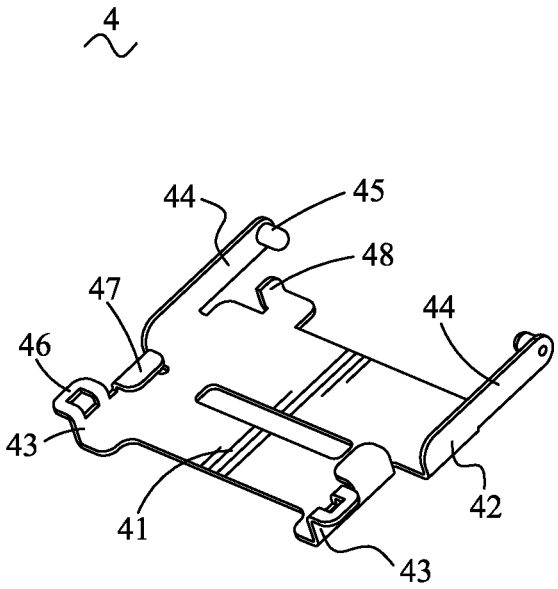
FIG. 3 is a perspective view of a holding shell of the holding device shown in FIG. 2.
Figure 6:
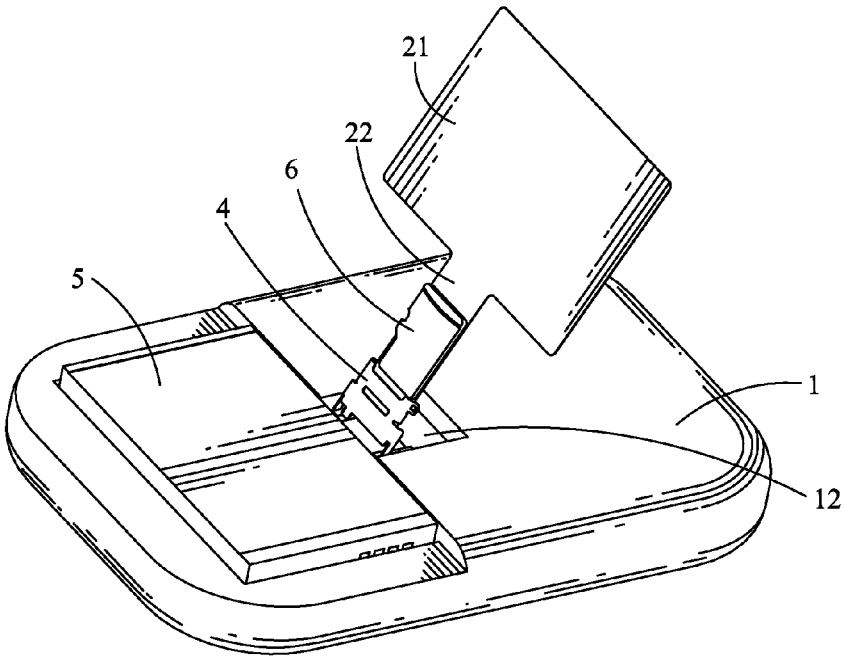
Figure 7:
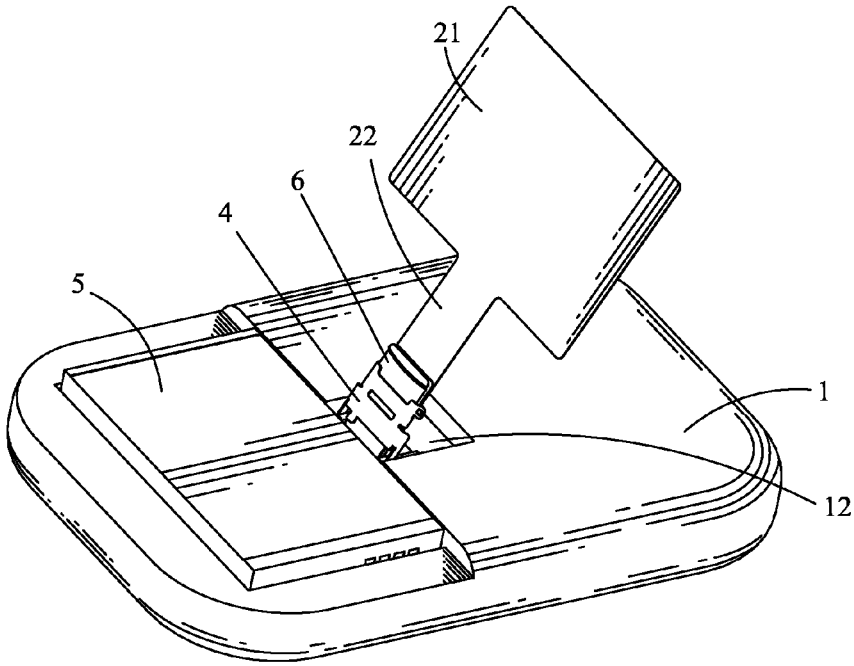
Figure 8:
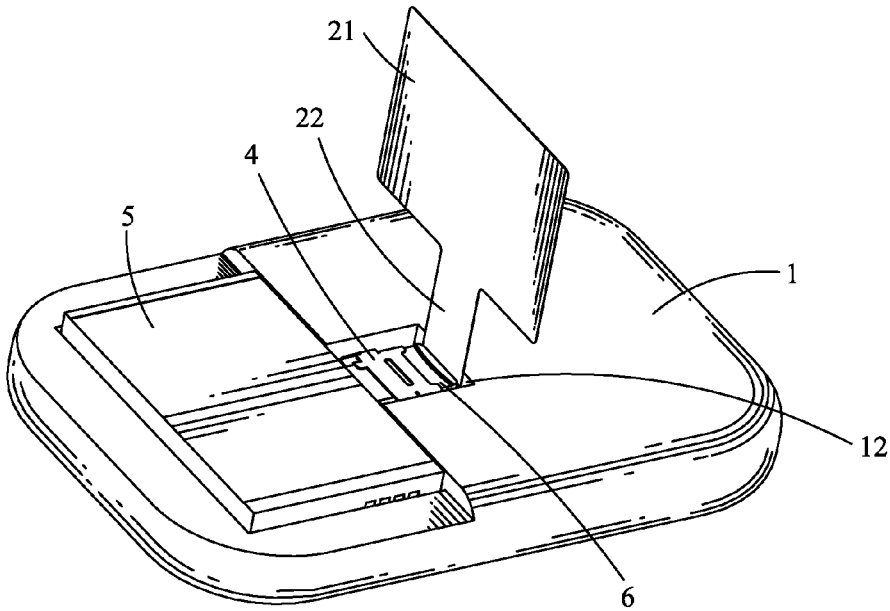

Referring to FIGS. 2-3 and FIG. 6, the holding shell 4 has a covering plate 41 of substantially oblong shape. The covering plate 41 defines a front end, and a rear end narrower than the front end. Two first and second lateral plates 42, 43 are extended perpendicularly and downwards from two opposite sides of the front end and the rear end, respectively. Each of the first lateral plates 42 has a front end extending forward to form a swingable arm 44. The swingable arm 44 has a free end protruded inwards to form a pivot 45, for being pivoted to the corresponding pivoting hole 7 of the insulating housing 31. A rear end of a bottom edge of each second lateral plate 43 is bent outwards to form a locking slice 46, for resting against a side of the securing recess 12. A front end of the bottom edge of each second lateral plate 43 is bent inwards to form a buckling slice 47 for holding the inserted connecting portion 22 of the antenna 2. The card 6 is inserted and sandwiched between the inserted connecting portion 22 and the covering plate 41. A front side of the covering plate 41 is extended downwards to form a positioning portion 48, adjacent to one first lateral plate 42 for blocking the inserted card 6. In this embodiment, the front side of the covering plate is protruded forwards to form a rectangular protruding slice, and the positioning portion is connected with a side of the protruding slice adjacent to the corresponding first lateral plate.

Please refer to FIG. 1 and FIGS. 5-8, in assembly, the holding shell 4 is pivoted to the insulating housing 31 by the pivots 45 engaged with the pivoting holes 7. When the antenna 2 is assembled to the holding device, the holding shell 4 is lifted upwards. The free end 220 of the connecting portion 22 is inserted into a space formed by the covering plate 41, the second lateral plates 43 and the buckling slices 47. The stopping rib 24 is located forwards of the buckling slices 47. The card 6 is inserted into a space formed by the covering plate 41, the second lateral plates 43, the positioning portion 48 and the connecting portion 22. In this embodiment, the antenna 2 is pulled outwards a distance with respect to the holding shell 4 until the stopping rib 24 rests against front sides of the buckling slices 47, for preventing the connecting portion 22 from sliding out of the holding shell 4. At this time, the contacting spots 23 are exactly connected to first contacts of the card 6 (not shown).

The holding shell 4, which holds the antenna 2 and the card 6, is rotated and coupled to the insulating housing 31. An exposed portion of the connecting portion 22 is folded up according to the card 6 and overlapped on the holding shell 4, with the radiating body 21 attached to a top of the battery 5. The card 6 has second contacts (not shown) connected with the terminals of the securing connector 3, thereby the card 6 electrically connected with the PCB of the mobile phone. It should be noted that the assembling steps could be changed for conforming to different demands and should not be limited.

It should be noted that the method of the holding shell pivoted to the holding device could be changed for meeting different demands, and should not be limited. For example, the pivoting holes can be formed at front ends of two opposite sides of the securing recess of the base. Correspondingly, the pivots are protruded outwards from the free ends of the two swingable arms, for engaging with the pivoting holes. Or, the free ends of the two swingable arms are formed with through holes, with pivot shafts provided for passing therethrough to engage with the pivoting holes.

As described above, the antenna 2 is made of the flexible printed circuit board. Since the flexible printed circuit board has high wiring density, light weight, excellent ductility, the antenna 2 can be assembled in the holding device in a folding manner, which reduces an occupied space and is away from other electrical components of the holding device, consequently, preventing from the interference and improving the quality of receiving and sending the signals. Furthermore, the antenna 2 is detachably mounted to the holding device, which prolongs the use time of the antenna 2 and saves resource.

What is claimed is:

1. A holding device having a printed circuit board, comprising:

a base having a securing recess at a top surface thereof;

a securing connector fixed in the securing recess and connected with the printed circuit board;

a holding shell rotatably covered to the securing connector;

a flexible antenna of flat plate shape, the antenna having a rectangular radiating body, and a strip-shaped connecting portion extended outwards from a side of the radiating body;

a card, the card being inserted between the holding shell and the connecting portion, for electrically connecting the antenna and the securing connector after the holding shell is rotated to couple with the securing connector, wherein a length of the connecting portion is substantially twice as the length of the card, a free end of the connecting portion is held by the holding shell and rotated to connect with the securing connector electrically and detachably, and an exposed portion of the connecting portion is bent so that the radiating body is attached to the top surface of the base.

2. The holding device as claimed in claim 1, wherein the exposed portion of the connecting portion is folded up according to the card and overlapped on the holding shell.

3. A holding device having a printed circuit board, comprising:

a base having a securing recess at a top surface thereof;

a securing connector fixed in the securing recess and connected with the printed circuit board;

a holding shell rotatably covered to the securing connector; and a flexible antenna of flat plate shape, the antenna having a rectangular radiating body, and a strip-shaped connecting portion extended outwards from a side of the radiating body, wherein a free end of the connecting portion is inserted into and held by the holding shell detachably, a card is inserted between the connecting portion and the holding shell for electrically connecting with the connecting portion, a length of the connecting portion is substantially twice as the length of the card, the holding shell is rotated to couple with the securing connector, with the card electrically connecting with the securing connector, and an exposed portion of the connecting portion is bent so that the radiating body is attached to the top surface of the base.

4. The holding device as claimed in claim 3, wherein the exposed portion of the connecting portion is folded up according to the card and overlapped on the holding shell.

5. The holding device as claimed in claim 3, wherein the holding shell has a covering plate of substantially oblong shape, two first and second lateral plates are extended perpendicularly and downwards from two opposite sides of a front end and a rear end of the covering plate, the second lateral plates restrain the inserted card and the inserted connecting portion of the antenna.

6. The holding device as claimed in claim 5, wherein each of the first lateral plates has a front end extending forward to form a swingable arm, the swingable arms are pivoted to an insulating housing of the securing connector, for making the holding shell rotate with respect to the securing connector.

7. The holding device as claimed in claim 6, wherein each swingable arm has a free end protruded inwards to form a pivot, which is pivoted to a pivoting hole formed at each front end of two opposite sides of the insulating housing.

8. The holding device as claimed in claim 5, wherein a bottom edge of each second lateral plate is bent outwards to form a locking slice, for resting against a side of the securing recess.

9. The holding device as claimed in claim 8, wherein the bottom edge of each second lateral plate has a portion forward of the locking slice bent inwards to form a buckling slice for holding the inserted connecting portion.

10. The holding device as claimed in claim 9, wherein a top surface of the free end of the connecting portion has a stopping rib, the inserted connecting portion is extruded by the inserted card so that the stopping rib is buckled with front sides of the buckling slices for preventing the connecting portion from departing from the holding shell.

11. The holding device as claimed in claim 3, wherein the antenna is made of flexible printed circuit board.

12. The holding device as claimed in claim 3, wherein a top surface of the free end of the connecting portion has a stopping rib, two opposite lateral plates of the holding shell have portions bent inwards to form two buckling slices which block the stopping rib of the inserted connecting portion under the intrusion of the inserted card, for preventing the inserted connecting portion from departing from the holding shell.

13. The holding device as claimed in claim 3, wherein the top surface of the base has a receiving trough at a front end thereof, for receiving a battery, the securing recess is located rearward of the receiving trough, the radiating body lies on a top surface of the battery.

14. A method for assembling an antenna to a holding device, comprising the steps of:

lifting a holding shell upwards;

putting a free end of a connecting portion of the antenna into a space formed by the holding shell;

inserting a card between a covering plate of the holding shell and the connecting portion, a length of the connecting portion being substantially twice as the length of the card;

rotating the holding shell to cover an insulating housing of a securing connector; and folding an exposed portion of the connecting portion to overlap on the holding shell, with a radiating body attached to a top of a base.

15. The method as claimed in claim 14, wherein the connecting portion is pulled outwards a distance after the card is inserted, for electrically connecting with the inserted card.

* * * * *